US008408545B2

(12) United States Patent
Marsh et al.

(10) Patent No.: US 8,408,545 B2
(45) Date of Patent: Apr. 2, 2013

(54) AUXILIARY FEED CONVEYOR

(75) Inventors: Jeffrey D. Marsh, Foristell, MO (US); Lynn W. Swenson, Johnsburg, IL (US); Michael A. Vickers, Lebanon, MO (US)

(73) Assignee: Perfect Systems, LLC, Foristell, MI (US)

( * ) Notice: Subject to any disclaimer, the term of this patent is extended or adjusted under 35 U.S.C. 154(b) by 56 days.

(21) Appl. No.: 12/953,648

(22) Filed: Nov. 24, 2010

(65) Prior Publication Data

US 2011/0121508 A1 May 26, 2011

Related U.S. Application Data

(60) Provisional application No. 61/264,438, filed on Nov. 25, 2009.

(51) Int. Cl.
*B65H 29/54* (2006.01)

(52) U.S. Cl. ..... 271/306; 271/208; 399/92; 399/315

(58) Field of Classification Search ..... 271/306, 271/208; 399/92, 315
See application file for complete search history.

(56) References Cited

U.S. PATENT DOCUMENTS

| | | | | |
|---|---|---|---|---|
| 4,994,861 | A * | 2/1991 | Brandon et al. | 399/315 |
| 5,326,093 | A * | 7/1994 | Sollitt | 271/306 |
| 5,660,383 | A * | 8/1997 | Ueffinger et al. | 271/3.18 |
| 2009/0252525 | A1 * | 10/2009 | Kojima | 399/92 |

* cited by examiner

*Primary Examiner* — Luis A Gonzalez
(74) *Attorney, Agent, or Firm* — Polster Lieder Woodruff & Lucchesi, L.C.

(57) ABSTRACT

Apparatus for feeding sheets of paper printed by a printer to a sheet processing device is disclosed where the printer has a sheet discharge outlet and the processing device has a sheet inlet at a different location (e.g., a different height) than the discharge outlet. A sheet conveyor is provided for conveying the sheets from the sheet discharge outlet to the sheet inlet. The apparatus blows air to cool on each sheet as it is conveyed from the discharge outlet to the sheet inlet, and the apparatus at least partially eliminates static electricity from the sheets as they are conveyed.

9 Claims, 3 Drawing Sheets

AUXILIARY FEED CONVEYOR

CROSS-REFERENCE TO RELATED APPLICATIONS

This application claims priority under 35 U.S.C. §119(e) to U.S. Provisional Patent Application No. 61/264,438, filed Nov. 25, 2009, and incorporates this Provisional Application by reference in its entirety.

STATEMENT REGARDING FEDERALLY SPONSORED RESEARCH OR DEVELOPMENT

Not Applicable.

BACKGROUND OF THE DISCLOSURE

This disclosure relates generally to a print on demand (POD) book printing and binding apparatus, such as shown in our co-pending U.S. patent application Ser. No. 12/576,923, filed Oct. 9, 2009, which is herein incorporated by reference in its entirety. In this apparatus for print on demand book manufacture, it is typical that a laser duplex page printer prints the text pages of the book on sheets of paper with one text page printed on each face of each sheet. After printing, the sheets are conveyed from the printer to an accumulator where they are accumulated to form a book block. As part of the printing process, the sheets are heated during the printing process to an elevated temperature so as to fuse the printer toner to the sheets. Because the sheets are rapidly conveyed from the printer to the accumulator remain at an elevated temperature (compared to ambient temperature) as they are accumulated in the stack or book block. Of course, because of the thermal mass of the book block the sheets in the book block remain at an elevated temperature for a matter of minutes. Oftentimes, prior to the sheets being stacked in the accumulator, the sheets are passed through a de-curling device, as indicated by reference character 13 in the above-noted U.S. patent application Ser. No. 12/576,923, so as to de-curl or flatten the sheets prior to accumulating them in an accumulator to form a book block or the like. However, the sheets pass through the de-curler so fast that little cooling takes place in the de-curler, particularly after the apparatus has come up to its normal operating temperature. Of course, the flatter the sheets are before they are stacked to form the book block, the flatter the book block and the book to be formed from the book block.

Further, when sheets are printed by such a laser printer and discharged therefrom, the sheets carry an electrostatic charge. As is known, such electrostatic charge on the sheets interferes with the uniform stacking of the sheets to form the book block or other document.

In the manufacture of such POD printing and binding apparatus, it is oftentimes necessary or desirable to utilize page printers of different manufacturers or different models of printers. Oftentimes, these printers have a sheet discharge at a different height so that it is problematic of how to adjust the height of the infeed of the POD apparatus and the discharge of the printer.

SUMMARY OF THE DISCLOSURE

Apparatus is disclosed for feeding sheets of paper printed by a printer to a sheet processing device, such as a print on demand (POD) book publishing system. The printer has a sheet discharge through which each sheet printed by the printer is ejected or discharged one sheet at a time. The printer heats the sheets to an elevated temperature as the sheets are printed, and the sheets printed by the printer and discharged from the printer carry a static electricity charge. The sheet processing device has a sheet infeed located at a location (height) different from the printer sheet discharge. The apparatus has a sheet conveyor that has an inlet, an outlet, and a conveyor path between the conveyor inlet and the conveyor outlet for conveying the sheets from the printer sheet discharge to the sheet processing device sheet infeed. The sheets are accumulated in a stack within the sheet processing device. The apparatus has at least one fan that blows air on each the sheet as the sheet is conveyed along the conveyor path so as to at least partially cool the sheet, and the apparatus has a static electricity eliminator located along the conveyor path for at least partially eliminating the static electricity from the sheets as they are conveyed from the printer to the sheet processing device such that as the sheets are accumulated in the stack they are sufficiently cooled and have sufficient static electricity removed therefrom so that the sheets may be uniformly stacked one on the other in the stack.

Other objects and features of this disclosure will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 3:
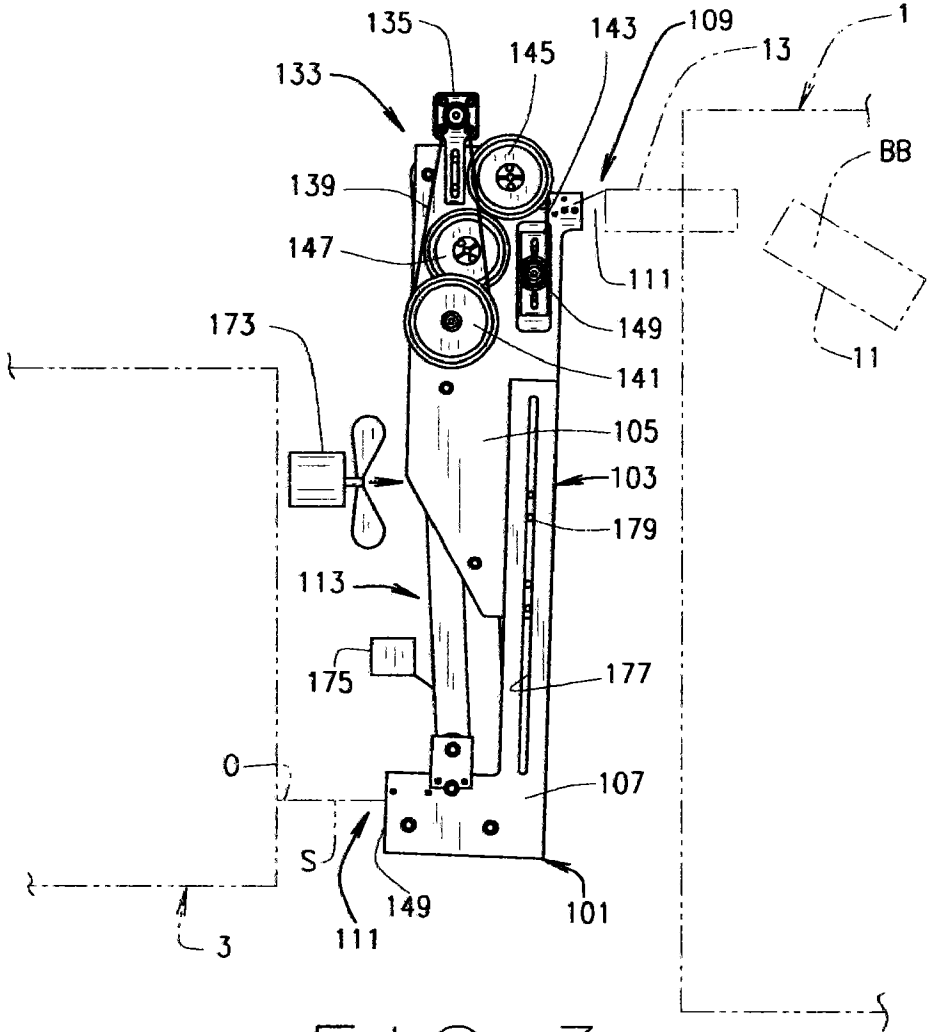
FIG. 3 is a right side elevational view of the sheet feeding apparatus shown in FIG. 2 further illustrating a printer (shown in phantom) to the left of the feeding apparatus and a sheet processing device (e.g., a print on demand book printing and binding device also shown in phantom) to the right of the feeding apparatus where the feeding apparatus conveys the sheets from the discharge of the printer to the inlet of the sheet processing device with the printer, with the printer, the feeding apparatus, and the sheet processing device moved apart from one another and from their normal operating positions for purposes of illustration, and further illustrating a fan for partially cooling the sheets and a static eliminator for removing static electricity from the sheets as they are conveyed.

Referring now to the drawings, and particularly to FIG. 3, in a print on demand (POD) book manufacturing system, as indicated at 1, sheets S of paper (or other suitable sheet material, such as a sheet of plastic film) that may form a book block BB, a stack of sheets, or other document, S are printed by a printer 3 (e.g., a laser printer or the like). As the sheets are printed by printer 3, they are discharged or ejected from the printer sheet discharge outlet O one sheet at a time. During the printing process, each sheet may be heated by the printer to an elevated temperature (e.g., up to about 250° F. or more, depending on the printer used) so as to fuse the toner to the sheet. Because the sheets are printed at high speed (for example, many duplex printers used with print on demand book publishing systems often print at a rate of one sheet printed on both sides per second, or greater), the temperature of the sheets discharged from the printer are still at an elevated temperature. Typically, the sheets are conveyed to an accumulator, as indicated at 11 in FIG. 3, in the POD book manufacturing system 1 in such a short time that they have little time to cool. In addition, because of the handling of the sheets in the printer and because of the printing process, it is typical that the sheets carry a static electricity charge as they are discharged from the printer. Of course, such static charges on the sheets make them difficult to stack uniformly stack in the accumulator. As referred to herein, the POD book manufacturing system 1 is also referred to as a sheet processing device.

Figure 4:
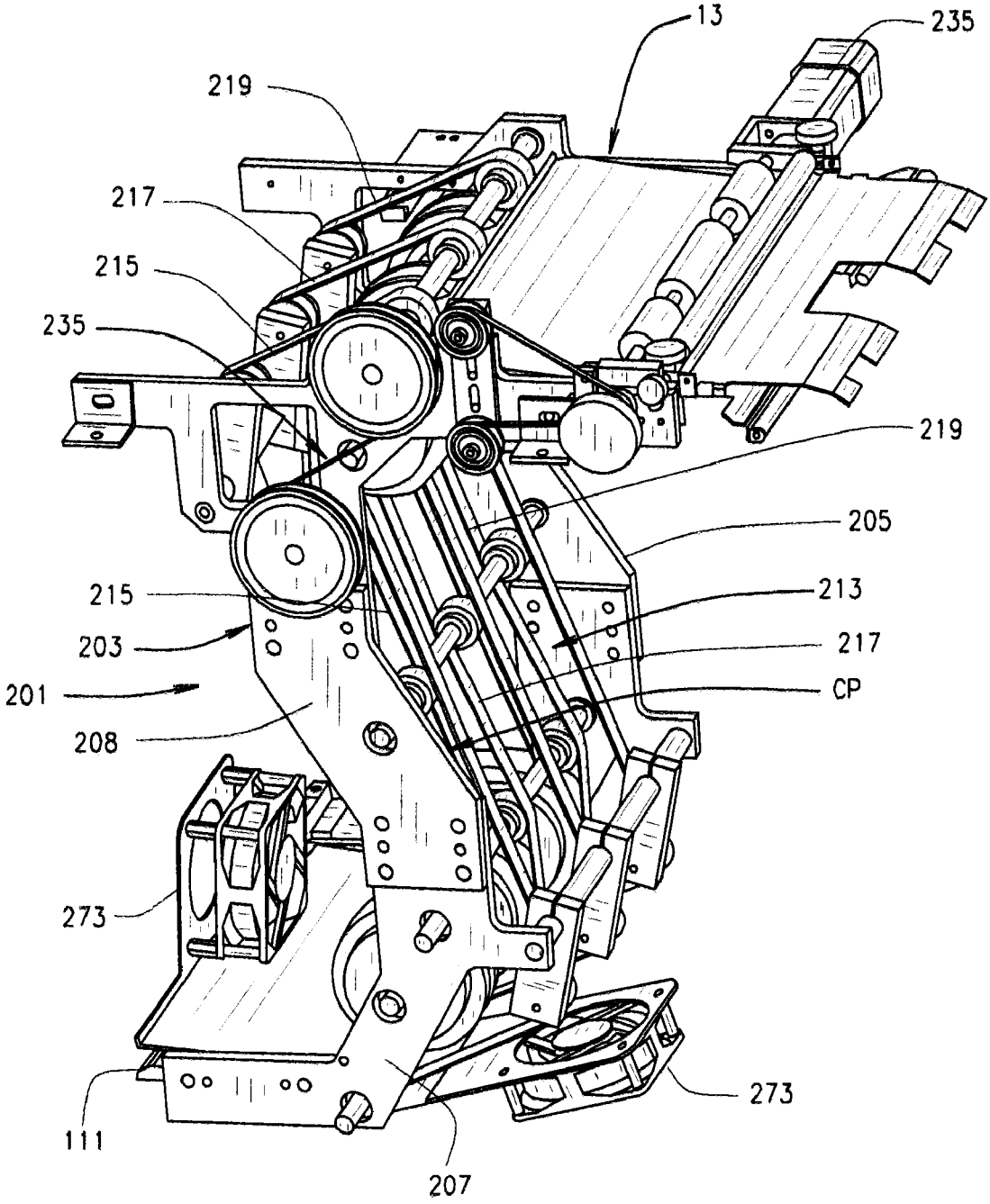
FIG. 4 is a perspective view of another embodiment of the sheet feeding apparatus, as shown in FIGS. 1-3, which as a more compact conveyor path such that the sheet feeding apparatus may be incorporated within the cabinet of a print on demand book publishing system rather than having to be a separate unit disposed between the printer and the print on demand book publishing system.

As disclosed in the above-noted co-pending U.S. patent application Ser. No. 12/576,923, filed Oct. 9, 2009, which is herein incorporated by reference, sheets from a printer 3 are discharged the infeed of a print on demand (POD) book publishing or manufacturing system, as generally indicated at 1 in FIG. 3. As noted, such a POD book manufacturing system may be referred to herein as a "sheet processing device", and it will be understood that the apparatus disclosed herein may be used with devices other than such a POD demand book manufacturing system. Specifically, it will be noted that the sheet infeed for the apparatus 1 includes a de-curler 13 that straightens each sheet and then feeds the sheets to accumulator 11 in which a stack of sheets is formed. This stack is oftentimes referred to as a book block BB in the context of a POD book publishing system, but the stack may also be for a document other than a book. This POD book publishing system, de-curler, accumulator and book block are best shown in FIGS. 3-5 of the above-noted U.S. patent application Ser. No. 12/576,923. While de-curler 13 is shown to be located just prior to the sheets being fed into accumulator 11, it will be understood that it could be located anywhere between the outlet O of printer 3 and the position shown in FIG. 1. For example, it has been noted that the de-curler may work better with relative hot sheets so that it may be preferred that the location of the de-curler is positioned proximate the printer sheet outlet O.

Figure 1:
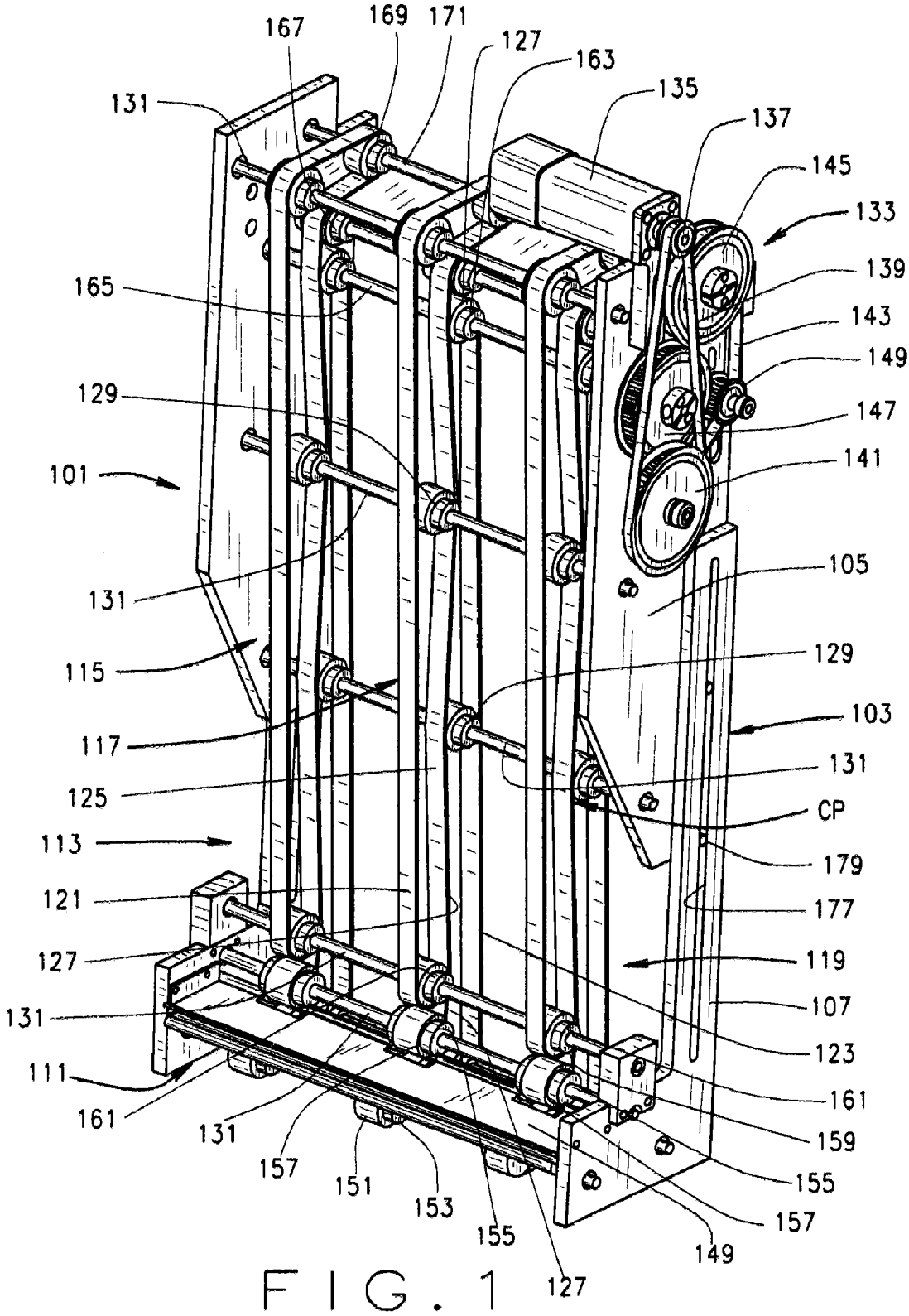
FIG. 1 is a perspective view of the apparatus of the present disclosure for feeding sheets of paper printed by a printer to a sheet processing device, such as print on demand book manufacturing system, where the printer has a sheet discharge at a different height than the sheet infeed for the sheet processing device, and where the apparatus conveys the sheets from the printer sheet discharge to the sheet infeed for the sheet processing device.

As shown in FIG. 1 of the above-noted U.S. patent application Ser. No. 12/576,923, the printer 3 may be supported on a raised platform or cart 9 so that the printed sheets discharged from the printer sheet outlet O may be readily fed into sheet infeed 109 (as more particularly described below). It will be appreciated that the necessity of providing such a cart so that the sheets discharged from the printer may enter the sheet infeed for the POD book publishing system is disadvantageous because upon installation of the POD book publishing system in a bookstore, office or the like requires that the printer 3 and its associated paper magazines be lifted and placed on this cart. Typically, such high speed duplex printers are heavy and thus are difficult to lift so as to place the printer on the cart. For some models of printers, they are so heavy that it is necessary that a fork lift or the like be provided to lift the printer onto the cart. It will be appreciated that it is often not possible to have such a fork lift in a retail store or office and thus the necessity of having to lift the printer onto the cart greatly complicates the installation of the POD apparatus 1. It will also be appreciated that after the POD book publishing system has been in place in an operating venue, it may be desirable to upgrade the printer 3 a different or more capable model. This change of the printer may result in the printer sheet discharge outlet O being at a different height so that it does not match the height of infeed of the POD apparatus 1.

In order to overcome the problem of having to support the printer so that the sheet outlet O of the printer is at the same elevation as the sheet infeed 109 of the sheet processing device (e.g., POD book publishing system 1), a sheet feeding apparatus or an auxiliary feed unit, as generally indicated at 101, in accordance with the instant disclosure may be provided for conveying sheets S of paper (or other sheet material, such as plastic film) printed by printer 3 to the infeed of the POD book publishing system 1 (or other sheet processing device).

More particularly, auxiliary feed unit 101 comprises a height adjustable frame, as generally indicated at 103, having an upper frame 105 and a lower frame 107 that may be vertically adjusted relative to one another for purposes as will appear. The auxiliary feed unit 101 is intended to be installed between printer 3 and POD apparatus 1 so as to receive sheets S printed by the printer discharged from the printer sheet outlet O, to convey these sheets, one at a time, from the printer outlet O to the inlet 109 (e.g., the inlet of de-curler 13) of POD apparatus 1. Auxiliary feed unit 101 has a sheet infeed 111 located at a location or height different from (below) the height of sheet infeed 111 so as to receive sheets printed by printer 3 as they are ejected or discharged from the printer sheet outlet O. The auxiliary feed unit further has a conveyor, as generally indicated at 113, which conveys the sheets from infeed 111 to inlet 109 of POD apparatus 1. Conveyor 113 has three spaced conveying devices, as indicated at 115, 117 and 119. These conveying devices grip sheets of paper or other stock ejected from the outlet O of printer 3 and conveys the sheets generally vertically to the infeed 111 of POD apparatus 1. As shown in FIGS. 1-4, these conveying devices 115, 117, and 119 are spaced pairs of endless conveyor belt sets (also indicated generally by reference characters 115, 117, and 119) that grip the sheet between each of the belts comprising each belt set. Each of these conveyor belt sets conveys the sheet in the same direction and at the same surface speed such that orientation of the sheet is maintained as the sheet is conveyed from the printer to the infeed of the POD apparatus 1. Since each of these conveyor belt sets is essentially identical to the others, it is only necessary to describe one set in detail. It will be understood that the width of conveyor 113 and the spacing of belt sets 115, 117 and 119 are such that a sheet of paper of a maximum predetermined width (e.g., 11 inches) may be conveyed by the conveyor. Preferably, but not necessarily, all three belt sets grip the sheet as it is conveyed.

More specifically, as best shown in FIG. 1, each set of the conveyor belts, for example belt set 117, comprises a first belt 121 and a second belt 123. These belts 121 and 123 are entrained around various drive and idler pulleys (as will be described) to as to form belt set 117. First belt 121 has an inner reach, as indicated at 125, and second belt 123 has an outer reach 127 with the inner reach 125 and the outer reach 127 being in face-to-face sheet gripping relation with one another and with a sheet S disposed therebetween. In this manner, a sheet S of paper printed by printer 3 and discharged from outlet O may be picked up by the conveyor 103 (in a manner as will be described below) and gripped by the reaches 125 and 127 of the three belt sets 115, 117 and 119 and positively conveyed to inlet 109 of the sheet processing device or POD book manufacturing system 1. It will be understood that the sheets S are discharged from the conveyor 103 with sufficient velocity that the sheet will readily pass through de-curler 13 and will seat itself within accumulator 11 so as to form book block BB. As described in the above-noted U.S. patent application Ser. No. 12/576,923. Intermediate idler rollers 129 rotatably mounted on shafts 131 maintain the reaches 125 and 127 in the above noted face-to-face gripping relation with the sheet. It will be appreciated that shafts 131 may be slightly spaced in horizontal direction relative to one another in and out of the vertical plane of the conveyor 113 so as to insure the inner reach 125 and outer reach 127 are in face-to-face gripping engagement with a sheet S disposed therebetween. It will be understood that reaches 125 and 127 of belts 121 and 123 move in the same direction (upwardly) and move at the same surface speed.

Figure 2:
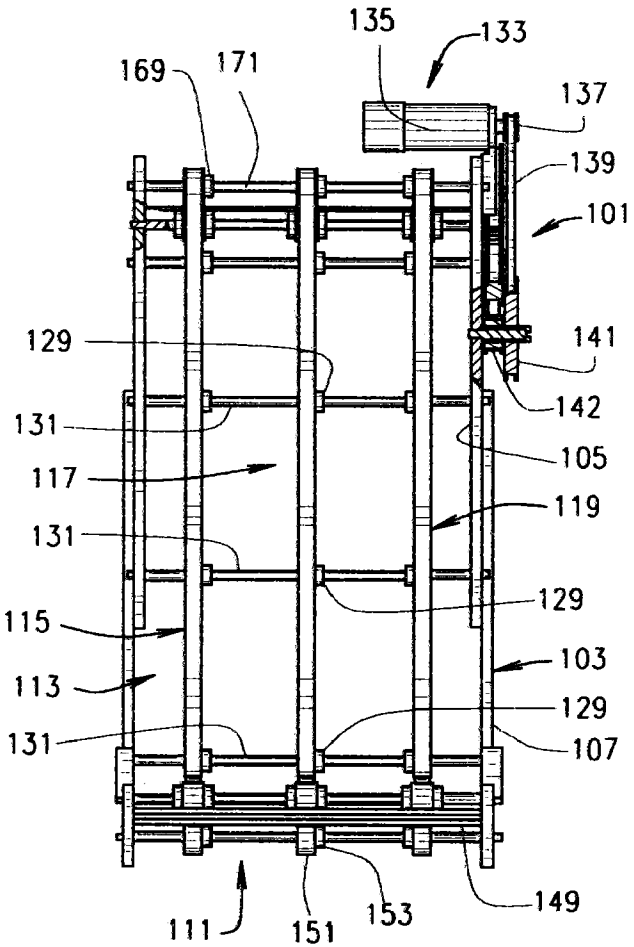
FIG. 2 is a front elevational view of the sheet feeding apparatus.

As best shown in FIGS. 1 and 3, a drive, as generally indicated at 133, is provided for conveyor 113. This drive comprises an electric motor 135 (such as a model BLY17MDS2S-24V-4000 motor commercially available from Anaheim Automation of Anaheim, Calif.). Preferably, motor 135 is a variable speed motor where the speed of rotation of its output shaft may be varied, where the motor is preferably under the control of computer control system CS, as described in the above-noted U.S. patent application Ser. No. 12/576,923. A drive pulley 137 is mounted on the output shaft of motor 135 and a drive belt 139 is entrained around drive pulley 137 and a driven pulley 141. A smaller diameter drive pulley, as indicated at 142 in FIG. 2, is mounted on the inside face of and is coaxially with driven pulley 141 and thus is driven at the same rotational speed in the same direction of rotation as pulley 141. A second drive belt 143 is entrained around this smaller diameter drive pulley 142 to drive driven pulleys 145 and 147. These last-mentioned driven pulleys are of the same diameter so that they are rotated at the same rotational speed, but in opposite directions, by belt 143 so that the inner reach 125 of belt 121 and the outer reach 127 of belt 123 are driven in the same direction (upwards, as shown in FIG. 1) for conveying the sheets S from inlet 111 to sheet inlet 109. An adjustable idler roller 149 maintains belt 143 under proper tension to drive pulleys 145 and 147

As indicated at 149, an inlet duct or channel is shown to be part of sheet inlet 111. As the leading edge of a sheet S discharged from printer discharge O is fed into duct 149, the guide serves as a sheet guide for guiding the leading edge of the sheet to be picked up by conveyor 113. As noted at 151 in FIG. 1, the lower ends of second belt 123 are entrained around an idler roller 153 just below guide 149, with roller 153 being located toward printer 3 relative to the vertical reach 127 of belt 123. Although not clearly shown in the drawings, the outer reach 127 of the second belt 123 extends generally horizontally rearwardly from the top of roller 153 and is partially entrained around an idler pulley or roller 155 so that the outer reach extends upwardly from roller 155. As viewed in FIG. 1, the lower surface of roller 155 forms a nip 157 with the outer face 127 of belt 123. It will be understood that as a sheet S is discharged from the printer, the sheet will be guided by guide 149 into nip 157 so that the leading edge of the sheet is gripped by nip 157. In this manner, the direction of movement of sheet S is changed from generally horizontal to generally vertical.

A short distance above roller 153, the outer reach 127 of belt 123 forms another nip 159 with the inner reach 125 of belt 117, the lower end of which is entrained around a lower idler roller 157. It will be appreciated that as the leading edge of a sheet S is conveyed around roller 153 that it encounters nip 159 and thus is gripped by the outer reach 127 of belt 123 and by the inner reach 125 of belt 121 and is thus conveyed. The lower end of the first belt 121 is entrained around a lowermost idler roller 161 so that the inner reach 125 of belt 121 is in face-to-face engagement with the outer reach 127 of the second belt 123 proximate roller 161. As noted above, the reaches 125, 127 move in the same direction (upwardly, as shown in the drawings) and the sheet S gripped therebetween is also moved at the surface speed of these belt reaches.

The upper end of the second belt 123 is entrained around a drive roller 163, which is mounted on a drive shaft 165, which in turn is driven in one direction by pulley 147. Immediately above roller 163, another idler roller 167 is journalled on its respective shaft 131 around which the inner reach 125 of the first belt 121 is entrained and is turned approximate 90° toward the sheet infeed unit (e.g., de-curler 13) of apparatus 1 so that the sheet S is also turned approximately 90° and is positively driven toward the sheet infeed unit 109 so as to move the sheet through the de-curler 13 and to be deposit (eject) each sheet in accumulator 11. The upper end of the first belt 121 is entrained around a drive roller 169 mounted on a drive shaft 171, which in turn is driven by pulley 145 in the direction opposite pulley 147.

It will be appreciated that the auxiliary infeed unit 101 is preferably turned on when the printer 3 is commanded to print and continues to operate so long as the printer is printing. It will also be understood that the surface speed of the inner reaches 125 and 127 of belts 121 and 123 is preferably somewhat greater than the surface speed at which printer 3 discharges or ejects sheets S from outlet O so as to insure that upon a sheet being gripped by the belts (in the manner heretofore described) is positively removed from the printer discharge O and is conveyed from the printer. In this manner, jams are minimized. Because the sheets S are first gripped along their leading edges, the sheets are maintained in tension as they are removed from the printer outlet O thus minimizing damage (folds or crinkles) in the sheets.

As noted, the sheets S discharged from printer 3 typically are at an elevated temperature and carry an electrostatic charge. One or more fans, as generally indicated at 173 in FIG. 3, may be provided along a conveyor path (as shown in FIG. 1) for cooling sheets S as they are conveyed from printer outlet O to the sheet inlet for apparatus 1 by blowing cooling, ambient temperature air on each sheet S as the sheet is conveyed by auxiliary feed unit 101. It will be understood that even though sheet S may only be resident in the auxiliary feed unit for a short time (e.g., about 1 second or less), because only one sheet at a time is conveyed the sheet is substantially cooled by fan 173 so that as the sheets are fed into accumulator 11 to form book block BB they are cooled. Further, because the sheets have been de-curled and cooled prior to their being stacked in accumulator 11, they tent do stack better in the accumulator. While de-curler 13 is depicted in FIG. 1 as being downstream from conveyor apparatus 101, it will be understood that channel 149 may be replaced with a de-curler which would then serve both as a de-curler and as the sheet infeed guide.

As indicated at 175 in FIG. 3, a static eliminator is provided along conveyor 113 of auxiliary feed unit 101 for substantially removing any static charge from each sheet S as the sheet is conveyed by the feed unit. The elimination of the static charge again results in the sheets being more uniformly stacked in the accumulator 11. As described above noted U.S. patent application Ser. No. 12/576,923, so-called sheet tappers, as indicated at 51 and 53, are provided to tap each sheet S delivered to the accumulator 11 so that the sheets in the book block or stack are evenly positioned in the stack so that the edges of the sheets are in alignment with one another. By eliminating the static charge from the sheets, the uniformity of the book block is greatly improved. It will be appreciated that any conventionally available static eliminator may be used. One such static eliminator is a model number ION369R-6 ionizing rod commercially available from Alpha Innovation, Inc., of Marblehead, Mass. This rod-type static eliminator 113 extends laterally across the conveyor path and is spaced relatively closely (e.g., about 1 inch or less) relative to the paper sheets conveyed therealong so as to remove or eliminate (or minimize) the static charge carried by such sheets.

As noted, FIG. 3 is a side elevation view of the apparatus 1, of printer 3 and of the sheet processing device 1 with these components being show spaced from one another for purposes of illustration. It will be appreciated that the auxiliary feed unit 101 is relatively thin and is disposed between printer 3 and the apparatus 1. It will be appreciated that in operation, the apparatus 101 is positioned in close proximity to printer 3 and to apparatus 1 and defines a paper transport or conveyor path from the printer to apparatus 1.

As previously noted, frame 103 may be adjusted, within a limited range, so as to vary the difference in height between sheet infeed 111 and the sheet out feed 109 so that different printers having different sheet discharge heights may be accommodated for use with POD apparatus 1. This height adjustment allows the conveyor apparatus 101 to adapt many different printers to the height of the sheet infeed 111 of the POD apparatus 1. In turn, this facilitates the rapid set-up of the apparatus 1 and printer 3 without the need of a cart so as to match the height of the sheet outlet O of the printer to the sheet infeed 111 of the POD apparatus. Further, it allows printer 3 to be exchanged with another printer that may have its sheet discharge outlet O at a different height. As noted, frame 103 has an upper frame section 105 and a lower frame section 107 that are heightwise adjustable relative to one another within a limited range. As shown in FIG. 3, a vertical slot 177 is provided in lower frame section 107 and bolts 179 extending from the upper frame section 103 are received in this slot. Thus, the upper and lower frame sections may be vertically adjusted relative to one another and when the frame sections are at their desired heights, the bolts may be tightened to secure the frame sections relative to one another. It will be appreciated that the length of belts 115, 117 and 119 may have to be shortened or lengthened if the height of the frame 101 is so changed or adjusted so that the belts remain under their desired tension.

Referring now to FIG. 4, another embodiment of the auxiliary feed unit is depicted generally at 201. The construction and operation of auxiliary feed unit 201 is generally similar to auxiliary feed unit 101 with the major difference being that unit 201 has an angled frame 203 so that the conveyor path is more compact, which in turn allows the unit 201 to be located within the cabinetry of the print on demand book publishing system 1 rather than being a separate unit positioned between the printer 3 and the POD system 1. Unit 201 also has an upper frame 205 and a lower frame 207 joined together by angled frame members 208. It will be understood that by substituting different frame members 208 of different lengths and different angles that the height of the unit 201 may be readily changed. In FIG. 4, reference characters 203, 205, 207 etc. in unit 201 have a similar function as members 103, 105, 107 etc. in unit 101 and thus will not be described in detail.

As above described, the conveying devices 115, 117 and 119 that constitute a portion of conveyor path were shown to be pairs of conveyor belts having face-to-face belt reaches that gripped a sheet as it was discharged from the outlet O of printer 3 and conveyed the sheet to the inlet of POD apparatus 1. Those skilled in the art will recognize that the conveying devices need not be pairs of belts, but instead could be gangs of cooperating rollers (not shown). Each gang of rollers has a plurality of pairs of rollers where one of the pair is a driven roller driven at the same surface speed as the other driven rollers of all of the gangs. In that manner, all of the idler rollers are driven at the same speed as the driven rollers. In this manner, the driven rollers and the idler rollers in all of the gangs of rollers are driven in the same direction at the same surface speed. The driven rollers of each of conveying devices or gangs of rollers are driven by a common drive motor so that each of the driven rollers is driven at the same surface speed. Each pair of driven and idler rollers form a nip therebetween into which the leading edge of each sheet is fed so that the sheet my be conveyed by the rollers from outlet O of the printer to the sheet infeed 111 of the POD apparatus 1.

While the auxiliary feed units 101 and 201 of this disclosure were described in regard to feeding sheets of paper to a POD book printing and binding apparatus, it will be understood that these auxiliary feed units 101 may be used in conjunction with any sheet processing device that receives sheets of paper from a printer or other device.

As various changes could be made in the above constructions without departing from the broad scope of the invention, it is intended that all matter contained in the above description or shown in the accompanying drawings shall be interpreted as illustrative and not in a limiting sense.

The invention claimed is:

1. Apparatus for feeding sheets of paper printed by a printer to a sheet processing device;

said printer having a sheet discharge through which each sheet printed by the printer is discharged one sheet at a time;

said printer heating said sheets to an elevated temperature as said sheets are printed, said sheets printed by said printer and discharged therefrom carrying a static electricity charge;

said sheet processing device having a sheet infeed located at a location different from said printer sheet discharge;

said apparatus having a sheet conveyor having an inlet, an outlet, and a conveyor path between said conveyor inlet and said conveyor outlet for conveying said sheets from said printer sheet discharge to said sheet processing device sheet infeed with said sheets being accumulated in a stack within said sheet processing device;

said sheet conveyor comprising a plurality of conveying devices each gripping the leading edge of a sheet discharged from said printer with each of said conveying devices being driven at the same surface speed so as to convey the sheet along said conveyor path;

each of said conveying devices comprising a first belt and a second belt, said belts each having a reach substantially in face-to-face gripping contact with one another with said reaches moving in the same direction and being movable at substantially the same surface speed so that with a sheet gripped therebetween said sheet is conveyed along said conveyor path, said reaches extending substantially from said conveyor inlet to said conveyor outlet;

a drive for said belts such that said sheets are conveyed from said printer to said sheet processing device at a rate at least as fast as said sheets are discharged from said printer, said reaches of said belts in face-to-face gripping contact with said sheets being disposed generally in a vertical intermediate portion of said conveyor;

said conveyor path having a generally horizontal discharge portion at the upper end of said vertical intermediate portion;

each of said second belts being entrained at least partially around a first idler pulley disposed generally below said printer sheet discharge, and then at least partially around a second idler roller of said second belt downstream of said printer sheet discharge such that a leading edge of a sheet discharged from said printer sheet discharge enters a nip between said second idler roller and said inner reach of said second belt so that said sheet is gripped therebetween;

said apparatus having at least one fan that blows air on each said sheet as said sheet is conveyed along said conveyor path so as to at least partially cool said sheet; and said apparatus having a static electricity eliminator located along said conveyor path for at least partially eliminating said static electricity from said sheets as they are conveyed from said printer to said sheet processing device such that as said sheets are accumulated in said stack they are sufficiently cooled and have sufficient static electricity removed therefrom so that said sheets may be uniformly stacked one on the other in said stack.

2. Apparatus as set forth in claim 1 wherein said conveyor has a sheet infeed between said printer sheet discharge and said conveyor inlet, said sheet infeed comprising a duct in register with said printer sheet discharge for receiving sheets discharged from said printer and for guiding said sheets to said conveyor inlet.

3. Apparatus as set forth in claim 1 wherein said sheet infeed of said sheet processing device is located above said printer sheet discharge with said conveyor inlet being located generally at the lower end of said conveyor to receive said sheets from said printer sheet discharge, and wherein said conveyor path has a generally vertical intermediate portion.

4. Apparatus as set forth in claim 1 wherein said reach of said second belt downstream of said second idler roller turns said inner reach and said sheet from a generally horizontal direction to a generally vertical direction.

5. Apparatus as set forth in claim 4 wherein said first belt is entrained around a lower first belt idler roller such that said reaches of said first and second belts are in said face-to-face sheet gripping engagement with one another, and wherein said first belt reach and said second belt reach proximate said lower first belt idler roller form a nip into which sheet conveyed by said second belt reach and by said second idler roller feeds a leading edge of said sheet into this last-said nip so that said inner reaches may convey said sheet along conveyor path.

6. Apparatus as set forth in claim 5 having one or more intermediate idler rollers in engagement with said reaches of said first and second belts to as to maintain said inner reaches in face-to-face gripping engagement with one another and with a sheet gripped thereby.

7. Apparatus as set forth in claim 1 wherein said drive comprises a drive motor, a first driven pulley driven in one direction by said motor for driving said first belt and a second driven pulley driven in the opposite direction of said first drive pulley by said motor for driving said second belt so that said reaches in face-to-face engagement move in the same direction and at substantially the same surface speed.

8. Apparatus as set forth in claim 7 said drive, said pulleys, said idler pulleys and said belts are mounted on a frame, said frame having an upper section and a lower section that are adjustable relative to one another so as to vary the height that said conveyor conveys said sheets from said conveyor inlet to said conveyor outlet.

9. Apparatus as set forth in claim 1 wherein each of said conveying devices is a gang of rollers, each gang of rollers comprising a plurality of pairs of rollers, each said pair of rollers comprising a driven roller and an idler roller where each said idler roller is driven by its respective driven roller, each said pair of driven and idler rollers having a nip therebetween which grips a sheet thereby to convey said sheet along said conveyor path.

* * * * *